US009381561B2

(12) United States Patent
Van Essen

(10) Patent No.: US 9,381,561 B2
(45) Date of Patent: Jul. 5, 2016

(54) PINCH DECOMPRESSION IN RADIAL CRIMP PRESS MACHINES

(71) Applicant: Betaswage Pty Ltd., Altona VIC (AU)

(72) Inventor: Frederick Hubert Van Essen, Altona (AU)

(73) Assignee: Betaswage Pty Ltd, Altona VIC (AU)

( * ) Notice: Subject to any disclaimer, the term of this patent is extended or adjusted under 35 U.S.C. 154(b) by 53 days.

(21) Appl. No.: 14/223,317

(22) Filed: Mar. 24, 2014

(65) Prior Publication Data

US 2014/0283361 A1 Sep. 25, 2014

(30) Foreign Application Priority Data

Mar. 25, 2013 (AU) ..... 2013901016

(51) Int. Cl.
*B21D 39/04* (2006.01)

(52) U.S. Cl.
CPC ..... *B21D 39/048* (2013.01); *Y10T 29/49927* (2015.01); *Y10T 29/53657* (2015.01)

(58) Field of Classification Search
CPC ..... Y10T 29/53952; Y10T 29/53657; Y10T 29/49927; B21D 39/048
See application file for complete search history.

(56) References Cited

U.S. PATENT DOCUMENTS 6,526,642 B2 * 3/2003 Sausner ..... 29/407.05
2010/0263421 A1 * 10/2010 Van Essen ..... 72/6.1

* cited by examiner

*Primary Examiner* — Sarang Afzali
*Assistant Examiner* — Ruth G Hidalgo-Hernande
(74) *Attorney, Agent, or Firm* — Alston & Bird LLP

(57) ABSTRACT

The specification discloses a crimping process for crimping a metal ferrule (19) onto a hose (17) including the steps of applying a radially inwardly directed crimping force to die elements (16) adapted to engage the ferrule (19) and increasing said crimping force to a first level over a first period of time, at least partially removing the crimping force from said die elements after said first period of time, and reapplying the radially directed crimping force to said die elements (16) and increasing said crimping force to a second level over a second period of time, said second crimping force level being equal to, higher or lower than said first level, and at an end of the crimping process, removing the crimping force fully from the die elements (16).

9 Claims, 6 Drawing Sheets

PINCH DECOMPRESSION IN RADIAL CRIMP PRESS MACHINES

CROSS-REFERENCE TO RELATED APPLICATIONS

This application claims priority to and the benefit of Australian Patent Application No. 2013901016, filed Mar. 25, 2013, which is hereby incorporated by reference in its entirety.

BACKGROUND

1. Technical Field

The field of the present invention relates to improvements in crimp press machines for crimping ferrules forming an end connection for a flexible hose.

2. Description of Related Art

Conventional radial crimp presses have a die set made up of a plurality of dies surrounding a work or crimping zone, each of the dies are caused to simultaneously move inwardly against an outer surface of a metal ferrule surrounding a flexible hose placed in the work zone, by an axially moving piston member acting under an applied hydraulic pressure, the objective being to plastically deform the ferrule radially inwardly onto the flexible hose such that the ferrule and the hose are permanently connected together. The number of dies in a die set can be any number but it is relatively common to provide eight such dies in a die set, uniformly positioned around the work zone. Any crimp press will be required to crimp a range of different hoses and ferrules, each having a particular desired finished end crimp diameter. In order to crimp to various diameters, the crimp press will be supplied with die sets of various inner diameters that can be selected and installed in the press. The change-over of desired die sets can, however, add time to a crimping process. The objective generally is to crimp a particular ferrule to a desired specific reduced diameter on a desired hose. This is achieved by selecting a die set one size smaller than the required diameter and installing this die set in the crimp press, entering the required diameter in the crimp press controller and entering a "required offset valve" into the crimp press controller, and carrying out the crimping process. The crimp press will halt at a certain position such that the inner diameter of the installed die set will crimp the ferrule to the required "reduced" diameter. The formula being, "Die Set Closure Diameter"+"Offset Value"="Required Crimp Diameter.

The range of hoses and hose couplings are increasing. Hose assemblies are now required to operate more reliably and for many more cycles of use. Pressure ratings are generally also increasing. Further, innovative hose structures are being developed which must be able to have an end fitting (ferrule) crimped thereto. In the past, it was possible to have one die set per hose/hose coupling set, however crimp presses are now required to crimp to any diameter within a given range. One die set must be able to crimp any diameter within its "closure diameter" and max offset value.

The objective in a crimping process is to achieve the most round (cylindrical) crimped ferrule possible following a crimping process. Retention of the ferrule on the hose is enhanced by the use of multiple axially spaced annular ribs or teeth directed inwardly from an inner surface of the ferrule. The quality of retention of the ferrule on the hose and the operational life of the hose is affected by the roundness of the ferrule and therefore the aforesaid teeth following a crimping process. In practice, for a number of reasons, the crimping process is only able to achieve an approximation to the desired cylindrical shaping following a crimping process. Because the die sets having a specific die face curvature relating to their closure diameter, and they are required to crimp any diameter within a range, a compromise on "roundness" is accepted in practice. If the crimp press were supplied with many more die sets, then the operational range of each die set could be reduced and the end roundness would be less of a compromise. This, however, is generally not acceptable because of the increased cost of the crimp press and the increased process time as a result of the removal and installation of die sets into the crimp press. Thus there is a balance to be achieved involving the least number of die sets for achieving a desired level of performance.

An uncrimped ferrule will always be of larger diameter than the final crimp diameter of the ferrule and of the diameter of the "die contact surface" with the result being that as the die initially contacts the ferrule as the die starts to move radially inwardly, only the axial outer edges of the "die contact surface" engage with the ferrule. With further radial inward motion of the die elements, the ferrule is compressed in between the die elements but there is no compression underneath the die elements, i.e. between the axial outer edges of each die element. As a result, metal of the ferrule tends to bulge outwardly and inwardly in the zones between the die elements as the crimping process continues. Shaping of the inner annular ribs or teeth of the ferrule is also compromised producing an axially viewed shape tending to the polygonal rather than circular. When the crimping press utilizes eight die elements, the internal axially viewed shape tends to an octagonal shape. As a result, performance of the connection between the ferrule and the hose is compromised. In addition, because a crimping process occurs as a metal cold working process, the strength of the ferrule may be enhanced by the cold working process but this is non-uniform providing peripheral zones of enhanced strength interspaced by zones where the strength has not been enhanced. Further because the process described above provides a tangential compressive force component as well as a radial compressive force component at the contact edges of the die elements with the ferrule, a higher total compressive force is required to drive the die elements radially inwardly. Hence a more powerful (and therefore costly) crimp press is required.

The objective of the present invention is to provide a crimp press and a process of crimping that will seek to achieve a rounder inner ferrule configuration to improve performance of retention of a ferrule on a hose. A further preferred objective is to provide a crimp press and a process of crimping that will provide a more uniform peripheral strength of the ferrule after crimping.

BRIEF SUMMARY

In accordance with one aspect of the present invention, there is provided a crimping process for crimping a metal ferrule onto a hose, said crimping process including the steps of: applying a radially inwardly directed crimping force to die elements adapted to engage said ferrule and increasing said crimping force to a first level over a first period of time; at least partially removing crimping force from said die elements after said first period of time; reapplying the radially inwardly directed crimping force to said die elements and increasing said crimping force to a second level over a second period of time, said second level being equal to, higher or lower than said first level; and at an end of said crimping process, removing said crimping force fully from said die elements.

Preferred features of the aforesaid crimping process may be as defined in any one of the claims annexed hereto, the subject matter of these claims being included in the disclosure of this specification by this reference thereto.

The present invention also anticipates providing a crimp press for carrying out the process as defined in the preceding two paragraphs.

BRIEF DESCRIPTION OF SEVERAL VIEWS OF THE DRAWINGS

The invention may be better understood from the following non-limiting description of exemplary embodiments, in which.

DETAILED DESCRIPTION OF VARIOUS EMBODIMENTS

Figure 1:
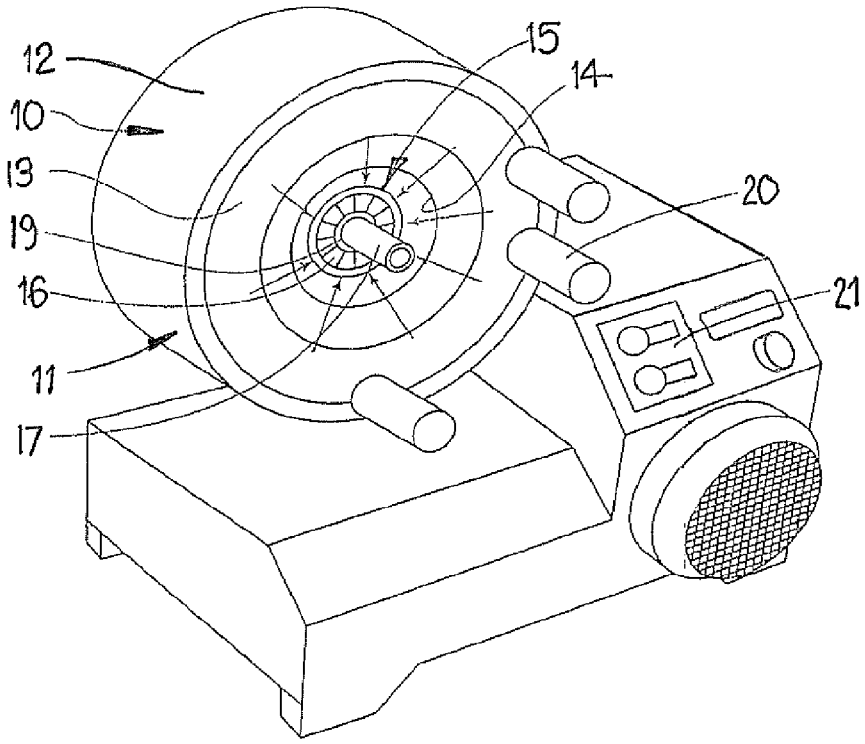
FIG. 1 is a schematic perspective drawing of a crimp press.

FIG. 1 shows schematically a crimp press 10 including a housing 11 with a front wall 13 and circumferential wall 12, the front wall 13 having a central opening 14 providing access to a work area 15. Within the work area 15 are a plurality of die elements 16 that are mounted to move in a radial direction inwardly and outwardly. An annular piston member (not shown) is axially movable within the housing 11 and has ramp surfaces engageable with ramp surfaces on circumferentially outer faces of the die elements 16 to effect inward radial movement of the die elements 16 as the piston member moves towards the front wall 13. Movement of the piston member is achieved by pressurized hydraulic fluid being introduced into a chamber to drive the piston member forward towards the front wall 13. In operation, a hose 17 with an end fitting 18 and ferrule 19 loosely connected is positioned within the work area 15 with the die elements 16 in a radially withdrawn position. The die elements 16 are then driven radially inwardly with sufficient force to reduce the diameter of the ferrule 19 to plastically deform the ferrule onto the hose 17. The crimp press 10 has a potentiometer 20 to sense axial position of the piston member which provides an in situ identifier of location of the inner engagement surfaces 22 of the die elements 16 which in turn indicates the diameter of the ferrule 19 during the crimping process.

Figure 2:
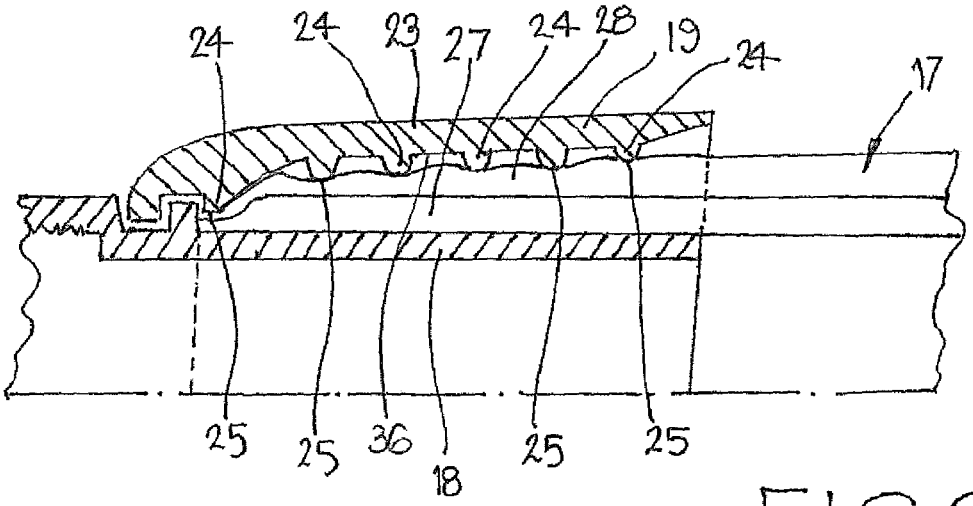
FIG. 2 is a part cross-sectional view of a hose coupling including a ferrule connected to a hose end.

FIG. 2 illustrates one possible form of a hose end coupling 18 and cooperating ferrule 19 and a hose 17 connected thereto. The hose coupling 18 will normally be configured depending on the intended application of the hose 17. The ferrule 19 normally will have an annular body section 23 with a plurality of annular inwardly projecting ribs or teeth 24 projecting into the space within the body section 13. The ribs or teeth 24 are axially spaced along the ferrule 19 and before crimping the inner tip zones 25 define a circular profile. The circular profiles may be of differing diameters as illustrated. As noted earlier, it is desirable for these circular profiles to, as far as possible, approach a circular profile after crimping. The illustrated hose 17 will have an inner elastomeric sleeve 27, an outer reinforcing metal mesh layer 28, and an outermost cover layer 50. The coupling 18 further includes a hose tail 51 having an inner portion 52 fitting within the hose 17 such that the inner elastomeric layer 27 of the hose fits over the inner portion 52. This inner portion 52 may include a series of axially spaced nibs and grooves 53 to improve gap with the hose inner layer 27. The hose tail 51 may further include an outer portion 54 of a variety of configurations. This structure is not, however, intended to be limiting as the nature, configuration and structure of the hose 17, hose coupling 18 including the ferrule 19 and hose tail 51 are not limiting on the scope of the present invention.

Figure 3:
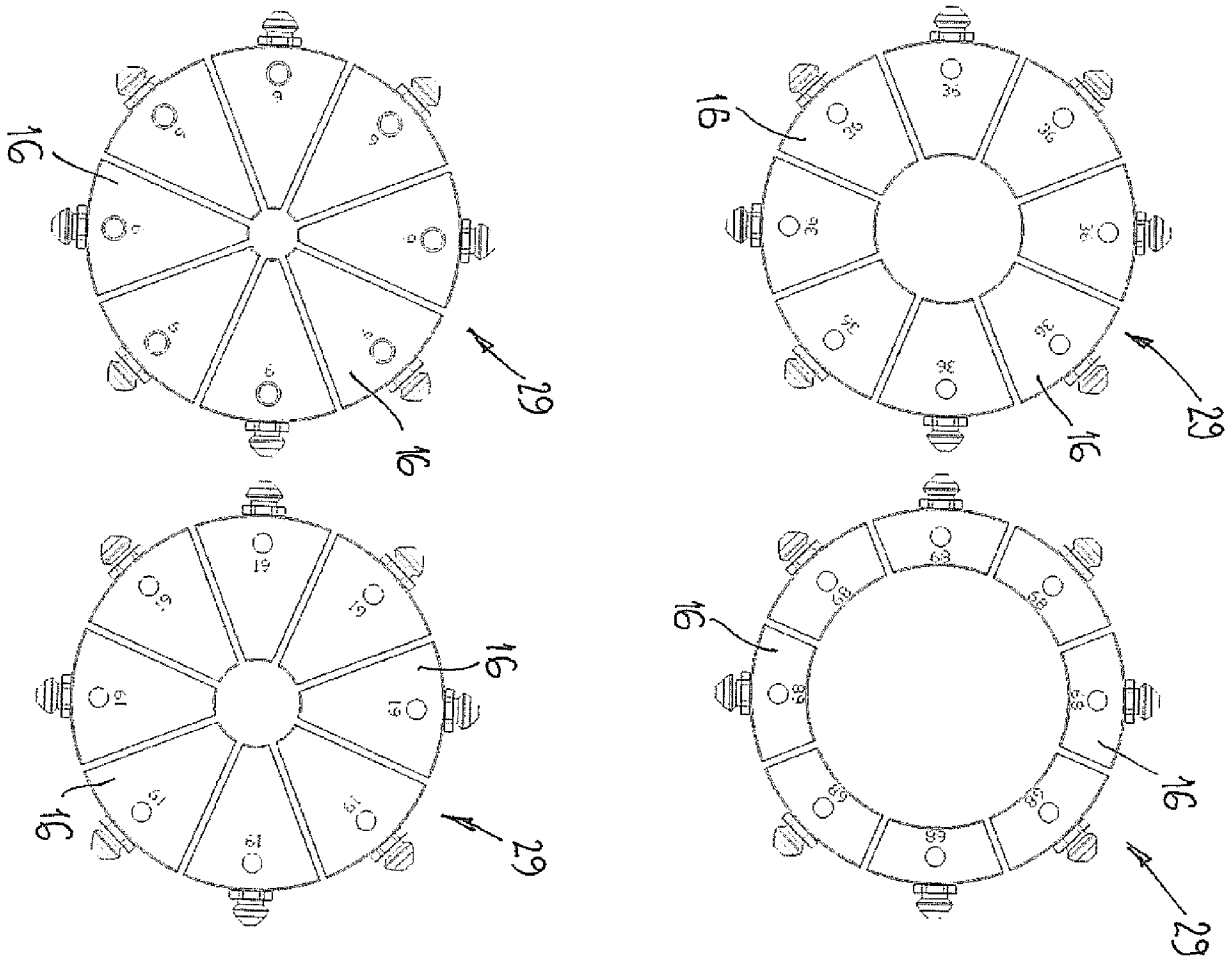
FIG. 3 is an axial view of a series of die sets that might be used in a conventional crimp press.

FIG. 3 illustrates a series of conventional die element sets 29 viewed axially, each with the die elements 16 of the set in an inner or closed position. A particular die set 29 is selected for use in the crimp press 10 on the basis of the selected die set being one size smaller than the required end crimp diameter for the particular ferrule being crimped.

Figure 4A:
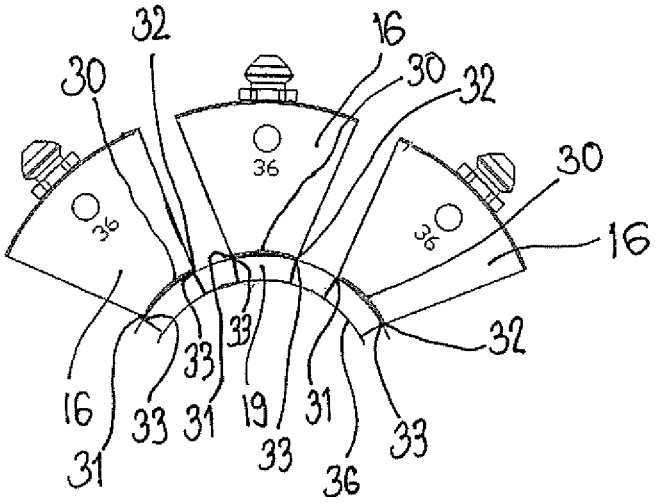
FIG. 4*a* is an axial view of three die elements of an eight die element set at the commencement of a conventional crimping process.
Figure 4B:
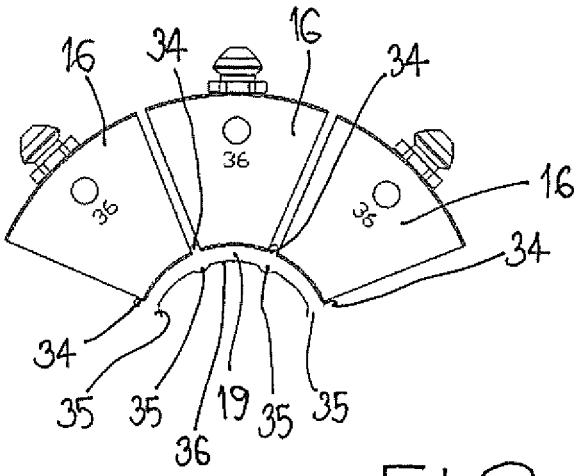
FIG. 4*b* is a view similar to FIG. 4*a* at the end of a crimping process.

FIG. 4*a* illustrates three die elements 16 of an eight die element die set at the point in time where the die elements 16 initially engage a round ferrule 19 before any deformation has occurred. The radius of curvature of the inner "contact" surfaces 30 of the die elements 16 are necessarily smaller than the radius of curvature of the outer surface of the ferrule 19 whereby only the outer axial edges 31, 32 of the inner surface 30 of the die elements 16 contact the outer surface of the ferrule 19. The contact is at a pinch point or pinch line 33 extending axially along the ferrule 19. Compression of the ferrule occurs along the lines 33 and between the die elements 16 but generally not underneath the die element inner surfaces 30 because of the lack of contact between this surface and the ferrule outer surface. FIG. 4*b* shows a view similar to FIG. 4*a* but after the die elements 16 have moved radially inwardly a distance to reduce and plastically deform the ferrule 19. At this point metal bulges 34 have been formed on the outer surface of the ferrule 19 between the die elements 16 and a wider bulge 35 has been formed at the same location on the inner surface 36 of the ferrule 19. As a result, the inner surface 36 is no longer round in the crimped form of the ferrule 19 and apart from the metal bulging that occurs at 35, the inner surface can also adopt a shape approximating a polygon (octagonal when eight die elements 16 are employed). The non-roundness of the inner surface 36 is a significant factor that can cause premature failure of the connection formed by the ferrule 19.

Figure 5:
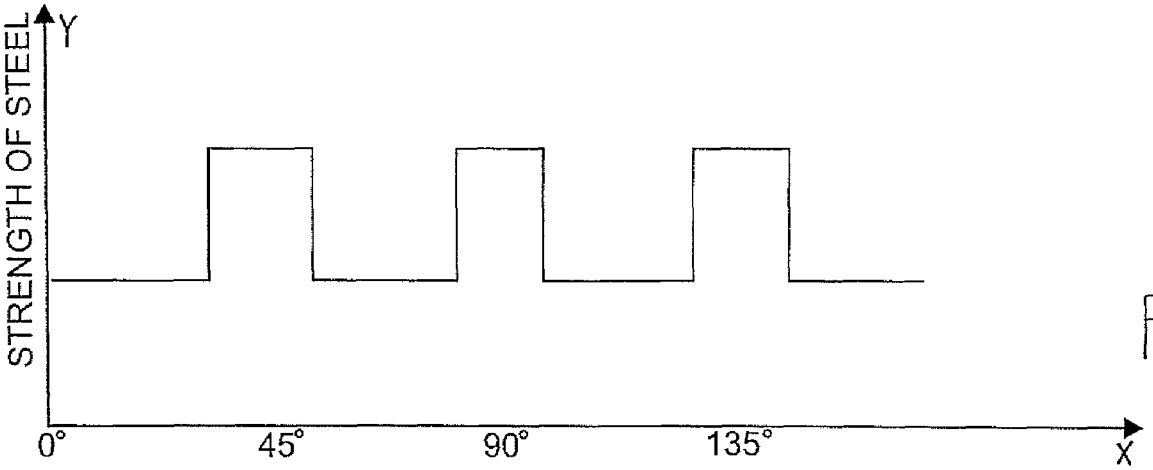
FIG. 5 is a graph showing peripheral distribution of ferrule strength following a crimping process.
Figure 6:
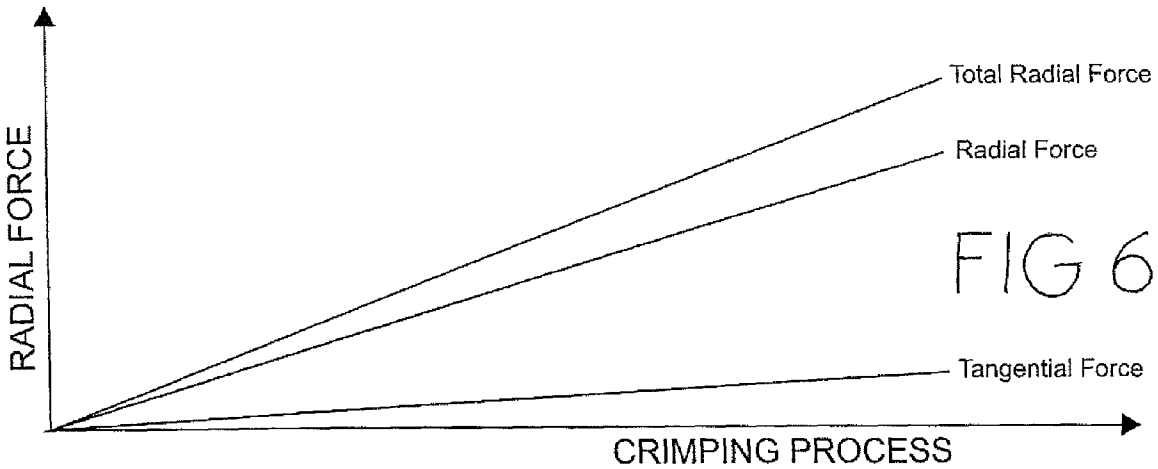
FIG. 6 is a graph showing forces applied to a ferrule during a conventional crimping process.

FIG. 5 is a graph illustrating the strength of the metal (normally steel) in the ferrule 19 against angular position around the periphery of the ferrule 19. The graph exhibits significant spiking of the strength at angular positions essentially adjacent the zones between the die elements 16. These spikes in strength occur because of the cold working hardening of the steel in the ferrule 19 in the zone adjacent the pinch lines 33. FIG. 6 illustrates a graph of radial force applied by the piston during the die elements inwardly during a conventional crimping process over the time of the crimping process. The total radial force linearly increases during the process and is made up of a tangential force and a radial force, the tangential force being directed tangentially to the outer surface of the ferrule 19 at the contact lines 33 and a radial force at this contact line. This total radial force is the force the crimp press must supply to achieve a desired crimping of any particular ferrule.

Figures 7A, 7B, 7C:
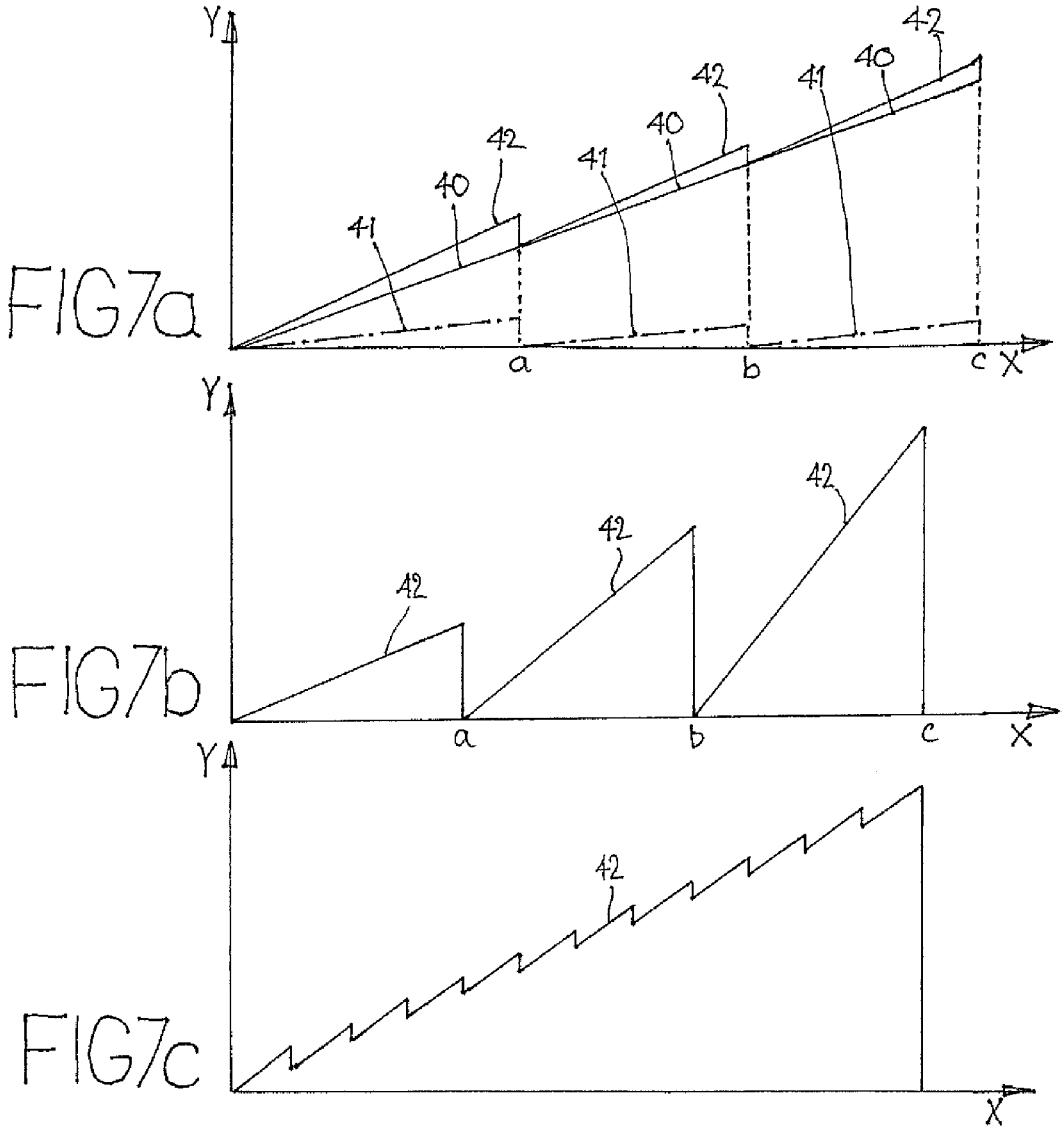
FIGS. 7*a*, 7*b* and 7*c* are graphs showing forces applied to the ferrule during a crimping process carried out according to the present invention.

In accordance with the present invention, the control system 21 of the crimp press 10 is configured to stall inward radial motion of the die elements 16 and the radial applied load is removed (decompression). The metal of the ferrule transitions during a crimping process through an elastic deformation, then a plastic deformation, and then partially elastically relaxes when decompression occurs. FIGS. 7*a*, 7*b*, 7*c* show potentially alternative embodiments of a pinch decompression crimping process according to the present invention. Each graph of these drawings plots radial forces applied to the die elements 16 (Y axis) against crimping process time (X axis). Line 40 represents radial only force, line 41 represents tangential only force, and line 42 represents the total of radial only and tangential only forces. Decompression occurs at periods throughout the process identified by a, b, and c. In FIG. 7*a*, at decompression, the radial force is only partially removed and in FIG. 7*b*, the radial force is fully removed. In FIG. 7*c*, the process provides a series of much quicker partial radial force removals at a multitude of decompression stages. While the graphs illustrate applied forces to the dies generally increasing between stages of decompression, the forces might alternatively be increased to be equal to or less than that of a preceding stage.

Figure 8:
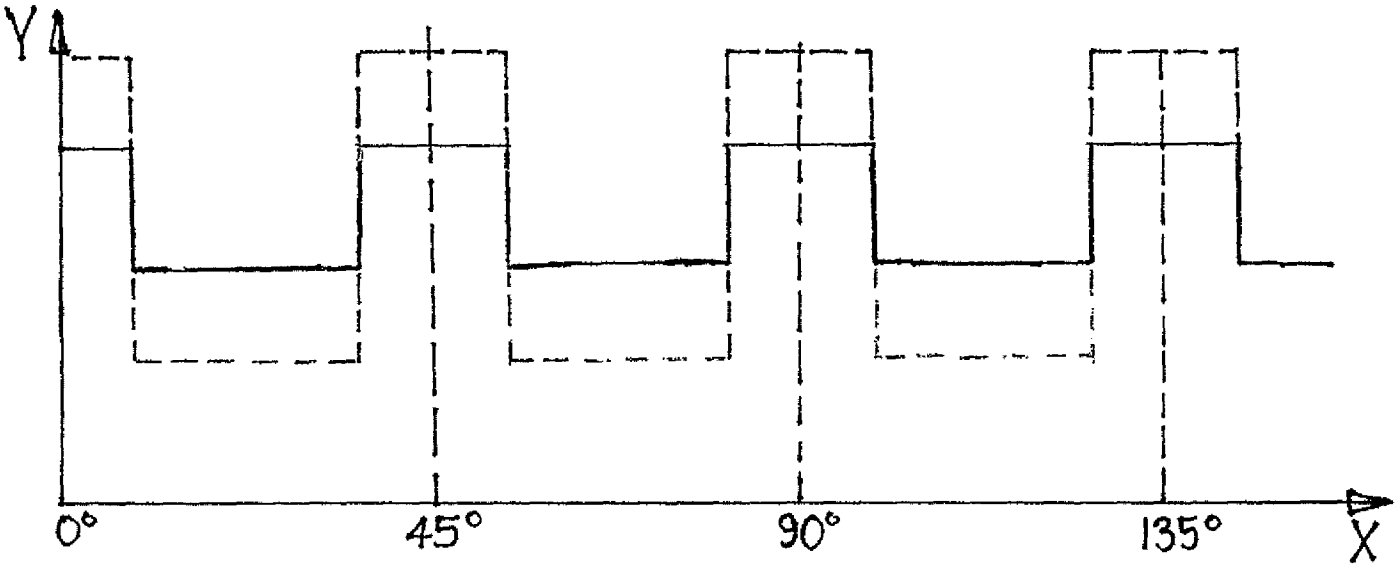
FIG. 8 is a graph showing peripheral steel strength in a ferrule following a crimping process according to the present invention with a comparison to the graph of FIG. 5.

When the radial load is reapplied after a decompression stage, the outer edges 31, 32 of the die elements 16 contact the ferrule 19 on the outer edges of the compressed metal bulges 34. The crimping process continues but with much less total force because the tangential force starts again from zero as when the crimping process initially commenced. As a result the final crimped ferrule 19 has much less bulging in the compressed areas 34, 35 and therefore the shape distortion on the inner surface 36 and the retention ribs or teeth 24 is much less than with a conventional crimping process. FIG. 8 illustrates the ferrule steel strength resulting from work hardening relative to angular disposition in the ferrule (full line) utilizing decompression and compares this to a conventional process (dashed line). The final radial force required to complete the crimping process will be less than if the process was carried out without decompression. The crimp press operator will not be required to maintain a "hold" on the assembly during the crimping process as the die elements 16 will not retract but only decompress or unload.

Advantages of the present invention include that the inner profile of the ferrule after crimping is more "round" than would have been the case with a conventional crimping process, that the strength of the ferrule is enhanced and distributed more uniformly, that a lower total applied force is required to complete any crimping process requiring a less powerful and more cost effective crimp press, and that any elastic recovery is less resulting in a more accurate crimped ferrule diameter. Of course, those skilled in the art will appreciate that the invention described herein is susceptible to variations and modifications other than those specifically described. All such variations and modifications are to be considered within the scope and spirit of the present invention the nature of which is to be determined from the foregoing description.

That which is claimed:

1. A crimping process for crimping a metal ferrule onto a hose, said crimping process comprising the steps of:

applying an inwardly directed crimping force to die elements adapted to engage said ferrule and increasing said inwardly directed crimping force to a first level over a first period of time, the inwardly directed crimping force comprising a radial force and a tangential force directed tangentially to an outer surface of the ferrule, wherein applying the inwardly directed crimping force results in bulges being formed on the ferrule between the die elements;

at least partially removing the inwardly directed crimping force from said die elements after said first period of time to allow the ferrule to relax, wherein at least partially removing the inwardly directed crimping force includes removing the tangential force applied to the ferrule;

reapplying the inwardly directed crimping force to said die elements, wherein reapplying the inwardly directed crimping force includes applying the inwardly directed crimping force on outer edges of the bulges on the ferrule and increasing said inwardly directed crimping force to a second level over a second period of time, said second level being equal to, higher or lower than said first level, wherein said increasing of said inwardly directed crimping force is due to the reapplying of the inwardly directed crimping force further including reapplying the tangential force; and at an end of said crimping process, removing said inwardly directed crimping force fully from said die elements.

2. The crimping process according to claim 1, further comprising, after said second period of time, the steps of:

at least partially removing the inwardly directed crimping force from said die elements; and reapplying the inwardly directed crimping force to said die elements and increasing said inwardly directed crimping force to a third level over a third period of time, said third level being equal to, higher or lower than said second level.

3. The crimping process according to claim 2, wherein said third level of said inwardly directed crimping force is higher than said second level.

4. The crimping process according to claim 1 wherein, after said second period of time:

the inwardly directed crimping force is at least partially removed from said die elements; and for subsequent multiple steps, the inwardly directed crimping force is reapplied to said die elements with the inwardly directed crimping force being increased over a further period of time to a level equal to, lower or greater than that of the level reached in an immediately preceding step, the inwardly directed crimping force being at least partially removed from said die elements between each step.

5. The crimping process according to claim 4 wherein the inwardly directed crimping force is successively increased from step to step.

6. The crimping process according to claim 1, wherein said second level of said inwardly directed crimping force is higher than said first level.

7. The crimping process according to claim 1, wherein said inwardly directed crimping force is reduced to zero between each step of applying said inwardly directed crimping force.

8. The crimping process according to claim 1, wherein periods of time of applying an increasing level of inwardly directed crimping force to said die elements are substantially equal to one another.

9. The crimping process according to claim 1, wherein:

the die elements are included in a crimp press;

the crimp press further comprises a control system; and the control system is configured for crimping the metal ferrule onto the hose.

* * * * *